United States Patent [19]

Eaton et al.

[11] Patent Number: 4,943,302

[45] Date of Patent: Jul. 24, 1990

[54] FUEL COMPOSITION WITH A HIGH ENERGY CONTENT

[75] Inventors: Philip Eaton, Chicago, Ill.; Nereo Nodari, Spino D'Adda, Italy; Carlo Neri; Luigi Cassar, both of San Donato Milanese, Italy; Fabio Monti, Rome, Italy; Fausto Alberici, Peschiera Borromeo, Italy

[73] Assignees: Enichem Synthesis S.p.A., Palermo; AGIP Petroli S.p.A., Rome, both of Italy

[21] Appl. No.: 420,050

[22] Filed: Oct. 11, 1989

[30] Foreign Application Priority Data

Oct. 14, 1988 [IT] Italy ..... 22296 A/88

[51] Int. Cl.[5] ..... C10L 1/16

[52] U.S. Cl. ..... 44/56; 585/14; 585/21; 585/360

[58] Field of Search ..... 44/56; 585/14, 360, 585/20, 21

[56] References Cited

U.S. PATENT DOCUMENTS

| | | | |
|---|---|---|---|
| 3,113,423 | 12/1963 | Kock | 585/14 |
| 3,113,424 | 12/1963 | Wineman | 585/360 |
| 3,558,704 | 1/1971 | Gregory | 564/556 |
| 4,604,183 | 8/1986 | Edelson et al. | 502/220 |
| 4,878,968 | 11/1989 | Willer et al. | 149/45 |

OTHER PUBLICATIONS

*The Merck Index*, Tenth Ed., Windholz, M. et al., Editor, Merck & Co. Inc., N.J., 1983, "2600 Cubane", p. 2595.

Eaton, P. E. et al., JACS, vol. 86, pp. 962–964 (1964).

Edward, J. T. et al., JACS, vol. 98, No. 11, pp. 3075–3085 (1976).

Davidson, R. B. et al., JACS, vol. 100, No. 7, pp. 2017–2021 (1978).

*Primary Examiner*—Margaret B. Medley

*Attorney, Agent, or Firm*—Hedman, Gibson, Costigan & Hoare

[57] ABSTRACT

A fuel composition with a high energy content, for direct-ignition internal combustion engines contains a gasoline from petroleum and an amount of up to 90% by volume, as referred to the same fuel composition, of hydrocarbon "cubane" or of its alkyl-derivatives, to be defined by means of the formula:

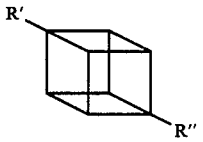

wherein R' and R'' represent, independently from each other, a hydrogen atom or an alkyl radical containing from 1 to 3 carbon atoms.

2 Claims, No Drawings

FUEL COMPOSITION WITH A HIGH ENERGY CONTENT

The present invention relates to a fuel composition for direct-ignition internal combustion engines, in particular a gasoline composition having a high energy content.

The gasolines available from the market, normally used for powering cars and other vehicles, are constituted by blends of hydrocarbons with an end distillation point not higher than 220° C., obtained from petroleum or from petroleum cuts.

The gasolines available from the market are characterized by a certain number of characteristics, such as specific gravity, volatility, homogeneity, stability and absence of corrosive power. Further characteristics, which become manifest at combustion time, are heat value, the thermal potential, the latent evaporation heat, antiknock power and resistance to pre-ignition, besides the corrosive power of the exhaust gases and the trend to form carbon deposits.

Among all of the above characteristics, heat value, i.e., the amount of energy supplied by a given amount of fuel, which is converted into work, is of primary importance. The available heat value of gasoline from petroleum varies within narrow limits, and is of the order of 10,500 kcal/kg.

Therefore, having available gasolines with a higher heat value than gasolines presently available from the market results interesting, in order to have available a larger amount of energy per each given amount of tranported fuel, and/or to reduce the overall dimensions of the transported fuel, with the amount of available energy being the same.

The present Applicant has found now that the above result can be achieved by means of the fuel composition with a high energy content for direct-ignition internal combustion engines, according to the present invention, with a high energy content, containing a gasoline from petroleum and an amount of up to 90% by volume, as referred to the same fuel composition, of hydrocarbon "cubane" or of its mono-alkly- or di-alkyl-derivatives, to be defined by means of the formula:

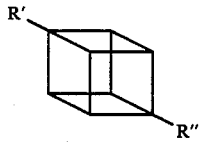

wherein R' and R'' represent, independently from each other, a hydrogen atom or an alkyl radical containing from 1 to 3 carbon atoms.

In the preferred form of practical embodiment of the present invention, the compositions contain from 20 to 60% by volume of cubane or of its mono-alkyl- or di-alkyl-derivatives.

The gasolines which can be used in the compositions according to the present invention are the usual gasolines constituted by a blend of hydrocarbons having an end distillation point not higher than 220° C., obtained from petroleum by distillation, or from petroleum cuts by means of thermal or catalytic treatments. Examples of such gasolines are reformed gasoline, cracked gasoline, polymer gasoline, alkylated gasoline, and stabilized gasoline.

Cubane and some of its derivatives are compounds known in the art, and described, e.g., by P. E. Eaton and T. W. Cole Jr., in J. Am. Chem. Soc., 86, 962, 3157 (1964) and by N. B. Chapman, J. M. Key and K. J. Toyne, in J. Org. Chem., 35, 3860 (1970). A synthesis of cubane, without any alkyl substituents, is reported in the following REACTION SCHEME. The relevant alkyl-substituted derivatives can be obtained by means of a similar route, by means of reactions of conversion starting, e.g., from the dicarboxylated derivative.

Cubane, in its form without the alkyl substituents, is a solid soluble in hydrocarbons, showing the following characteristics:

| | | |
|---|---|---|
| formation heat | +144 | kcal/mole, |
| strain energy | 166 | kcal/mole, |
| specific gravity | 1,29 | g/ml. |

Although it is thermodynamically unstable, cubane is kinetically stable up to 200° C. The bond angles and the bond lengths in its molecule are considerably different from the normal values as associated with an $sp^3$ hybridization of carbon, such a deviation being a measure of the strain energy contained in the molecule, with the consequent negative increase in combustion heat as compared to non-strained systems.

The incorporation of such high energy levels in a so compact system is exploited in the compositions according to the present invention in order to obtain highly energetic fuel compositions, capable of developing a higher combustion heat per each volume unit of the composition, also taking advantage of the higher density of cubane than normal gasolines.

REACTION SCHEME

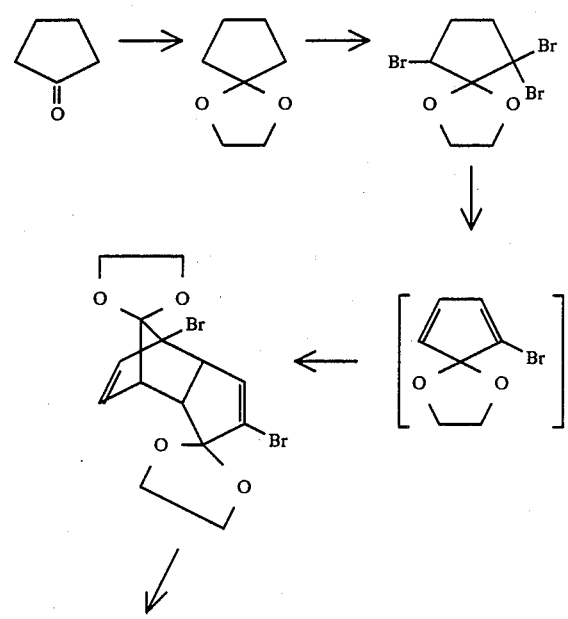

-continued

REACTION SCHEME

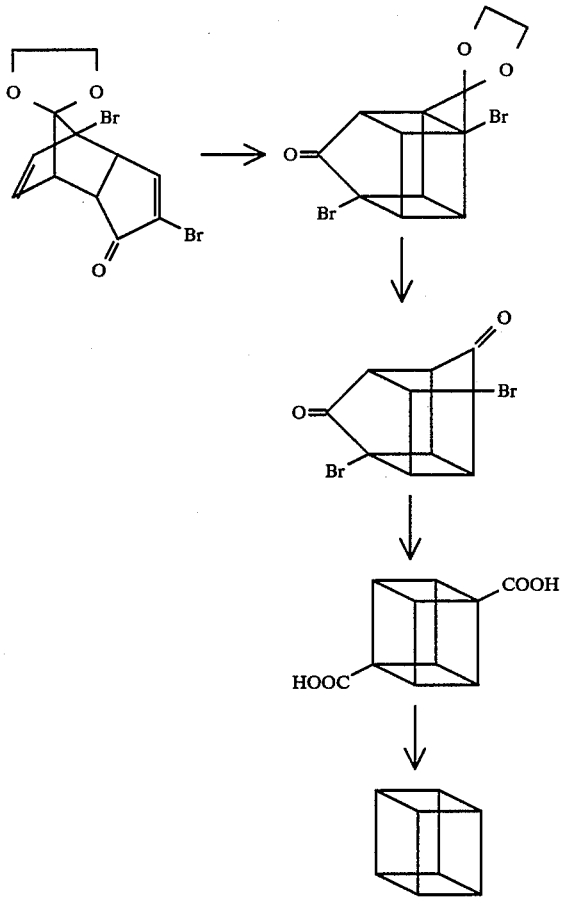

More particularly, the advantage of the use of cubane as a fuel for controlled-ignition internal combustion engines is due to two main characteristics:

The heat value, of 11,115 kcal/kg, which enables this substance to store an energy content about 5% higher than of a conventional gasoline; and the stoichiometric mixing ratio of 13.2 kg of air/kg of cubane, which makes it possible, with the amount of air intaken by the engine being the same, a complete and regular combustion of cubane in an amount higher than about 9% by weight relatively to a conventional gasoline, to be obtained.

The combination of both of the above advantageous features results, with the engine operating conditions being the same, in an increase in the energy content of cubane of about 14% as compared to a conventional gasoline.

EXAMPLE

An experimental check was carried out on a laboratory, single-cylinder engine, the main features of which as listed hereinunder:

| | |
|---|---|
| Engine | RICARDO "HYDRA" |
| Type | single-cylinder/vertical/aspirated |
| Feed | injection feed |
| Injection pump | Mico Bosch type "A" |
| Fuel pressure | 2 bar |
| Compression ratio | 9.0:1 |
| Swept volume | 447 cc |

-continued

| | |
|---|---|
| Stroke | 88,90 mm |
| Bore | 80,26 mm |
| Maximal power | 16 kW |
| Maximal speed | 5,400 rpm |

The performance of the engine—in terms of delivered power and of specific consumptions under maximal load conditions—were evaluated by using conventional gasoline, as compared to a composition containing 70% by volume of conventional gasoline and 30% by volume of cubane, under the stoichiometric mixing ratio.

| Engine speed (rpm) | Delivered power (kW) | Specific consumption (g/kWh) |
|---|---|---|
| | Conventional gasoline (stoichiometric A/F ratio: 14.6 | |
| 1200 | 4 | 300 |
| 2400 | 8.8 | 225 |
| 3600 | 13 | 280 |
| 4800 | 15.5 | 300 |
| 5400 | 16 | 330 |
| | Conventional gasoline 70% by vol. + cubane 30% by vol. (stoichiometric A/F ratio: 14.1) | |
| 1200 | 4.2 | 295 |
| 2400 | 9.3 | 221 |
| 3600 | 13.8 | 277 |
| 4800 | 16.5 | 297 |
| 5400 | 17.0 | 324 |

When the composition containing 30% by volume of cubane is used, increases in engine delivered power comprised within the range of from 5.0 to 6.4%, and decreases in specific consumption values comprised within the range of from 1.0 to 1.6%, are obtained.

These characteristics can be advantageously used above all on racing cars, for which cars the best compromise is sought between delivered power, and limited weights and overall dimensions.

One might observe, e.g., besides the above reported possible increases in power, that the use of a composition containing 30% by volume of cubane involves, as compared to conventional fuel, and with the weight on board of the vehicle being the same, a decrease in fuel volume of about 17%, accompanied by an increase of 1.5% in same fuel's energy content. The tendential consequence thereof is a decrease in consumptions and an increase in cruising radius.

We claim:

1. Fuel composition for direct-ignition internal combustion engines, with a high energy content, containing a gasoline from petroleum and an amount of up to 90% by volume, as referred to the same fuel composition, of hydrocarbon "cubane" or of its mono-alkyl-or di-alkyl-derivatives, to be defined by means of the formula:

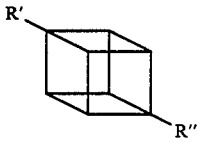

wherein R' and R'' represent, independently from each other, a hydrogen atom or an alkyl radical containing from 1 to 3 carbon atoms.

2. Composition according to claim 1, characterized in that it contains from 20 to 60% by volume of cubane or of its mono-alkyl- or di-alkyl-derivatives.

* * * * *